US005283995A

United States Patent [19]

Richter

[11] Patent Number: 5,283,995

[45] Date of Patent: Feb. 8, 1994

[54] DOOR LIGHT FRAME ASSEMBLY

[75] Inventor: Thomas S. Richter, Rock Falls, Ill.

[73] Assignee: Frantz Manufacturing Company, Sterling, Ill.

[21] Appl. No.: 877,802

[22] Filed: May 4, 1992

[51] Int. Cl.[5] ..... E06B 1/34

[52] U.S. Cl. ..... 52/202; 52/204.6; 52/208; 52/397; 52/476

[58] Field of Search ..... 52/202, 203, 204, 222, 52/311, 775, 475, 476, 397, 455, 204.6, 204.51

[56] References Cited

U.S. PATENT DOCUMENTS

| | | | |
|---|---|---|---|
| 2,177,001 | 10/1939 | Owen | 52/203 |
| 2,407,086 | 9/1946 | Ledwinka et al. | 52/476 |
| 2,945,269 | 7/1960 | Domen | 52/476 |
| 3,824,753 | 7/1974 | Anderson | 52/203 |
| 4,258,517 | 3/1981 | Hammond | 52/202 |
| 4,266,594 | 5/1981 | Gunn | 52/202 |
| 4,335,552 | 6/1982 | Blanchett et al. | 52/202 |
| 4,570,399 | 2/1986 | Wentink | 52/455 |
| 4,628,655 | 12/1986 | Scheiderer | 52/397 |
| 4,841,696 | 6/1989 | Miller | 52/202 |
| 4,920,718 | 5/1990 | Artwick et al. | 52/475 |
| 4,947,597 | 8/1990 | Simpson | 52/397 |
| 4,972,639 | 11/1990 | Woznick | 52/202 |
| 5,123,211 | 6/1992 | Schlicht et al. | 52/202 |

OTHER PUBLICATIONS

Anderson Door Co. advertisement (p. 71).
APCO advertisement (p. 19).
Plycraft brochure.
National window frames catalog (p. 101).
Thermidor Inc. instruction sheet.
Raynor Manufacturing Co. catalog (cover and pp. 8-12 & 15).
GADCO catalog (cover and p. 8).

*Primary Examiner*—Carl D. Friedman
*Assistant Examiner*—Winnie Yip
*Attorney, Agent, or Firm*—Emrich & Dithmar

[57] ABSTRACT

A door light frame assembly adapted for use with any of three different types of door construction includes a universal outer frame structure, attachable by screws to any one of three different inner frame structures, depending upon the type of door construction with which the frame assembly is to be used, for securely gripping the inner and outer sides of the door construction around the perimeter of an opening therethrough. The inner and outer frame structures, when assembled, also cooperate to define two separate peripheral channels of different widths for respectively clamping two different-thicknesses of window pane units. The outer frame structure also includes a peripheral groove cut away at two spaced-apart locations therein to define access openings for receiving therein peripheral edge portions of a flexible insert.

13 Claims, 4 Drawing Sheets

DOOR LIGHT FRAME ASSEMBLY

BACKGROUND OF THE INVENTION

1. Field of the Invention

The present invention relates to window frame assemblies and, in particular, to frames for door lights.

2. Description of the Prior Art

It is known to provide door light frame assemblies, i.e., assemblies for installing a glass or other type glazing member in an opening in a door. Typically, such frame assemblies may comprise inner and outer frame structures which are shaped to fit in the opening and respectively engage the inner and outer sides of the door around the perimeter of the opening for cooperation to clamp therebetween a window pane unit. Such frame assemblies are typically specifically designed for the particular type of door construction in which the door light is to be mounted. The frame assembly may also be specifically designed to accommodate a particular thickness of window pane unit.

It is also known to provide frame assemblies with an adjustable-width channel for accommodating different thicknesses of window pane unit, such as a single strength non-insulated window pane or an insulated double pane unit, but this usually requires adjustment of the separation between the inner and outer frame structures.

Door light assemblies are sometimes provided with decorative inserts in the nature of a covering for the window pane unit which is provided with one or more openings therein to expose predetermined portions of the pane unit and give the appearance of a different-shaped window. Commonly, such inserts are clamped between the window pane unit and the frame assembly. This, however, necessitates disassembly of the door light unit if the insert is to be removed for cleaning, replacement with a different type insert, or the like.

SUMMARY OF THE INVENTION

It is a general object of the present invention to provide an improved door light assembly and, in particular, a frame assembly therefor, which avoids the disadvantages of prior frame assemblies while affording additional structural and operating advantages.

An important feature of the invention is the provision of a window framing structure which has two window pane channels for respectively accommodating different-thickness window pane units.

In connection with the foregoing feature, another feature of the invention is the provision of a window framing structure of the type set forth, which comprises inner and outer frame structures interconnected for clamping the window pane unit and for clampingly engaging the associated door or other wall structure in which the window is mounted.

Another feature of the invention is the provision of a framing structure of the type set forth, which permits mounting and demounting of an associated decorative insert without disassembly of the framing structure.

Still another feature of the invention is the provision of a light unit frame assembly incorporating a framing structure of the type set forth.

Yet another feature of the invention is the provision of a framing structure of the type set forth which is adaptable for use with different types of door structures in which the window is to be mounted.

These and other features of the invention are attained by providing window framing structure for accommodating first and second window pane units having different thicknesses and each having a peripheral edge, the framing structure comprising: peripheral frame body means defining an aperture therethrough and shaped and dimensioned to extend around the periphery of an associated window pane unit, the body means including first peripheral channel means defining a first channel extending around the perimeter of and opening toward the aperture, and second peripheral channel means defining a second channel extending around the perimeter of and opening toward the aperture, the first and second channels being respectively dimensioned to receive therein the peripheral edges of associated first and second pane units for firm support thereof.

The invention consists of certain novel features and a combination of parts hereinafter fully described, illustrated in the accompanying drawings, and particularly pointed out in the appended claims, it being understood that various changes in the details may be made without departing from the spirit, or sacrificing any of the advantages of the present invention.

BRIEF DESCRIPTION OF THE DRAWINGS

For the purpose of facilitating an understanding of the invention, there are illustrated in the accompanying drawings preferred embodiments thereof, from an inspection of which, when considered in concoction with the following description, the invention, its construction and operation, and many of its advantages should be readily understood and appreciated.

DESCRIPTION OF THE PREFERRED EMBODIMENTS

Figures 1, 2, 3, 4, 5, 6:
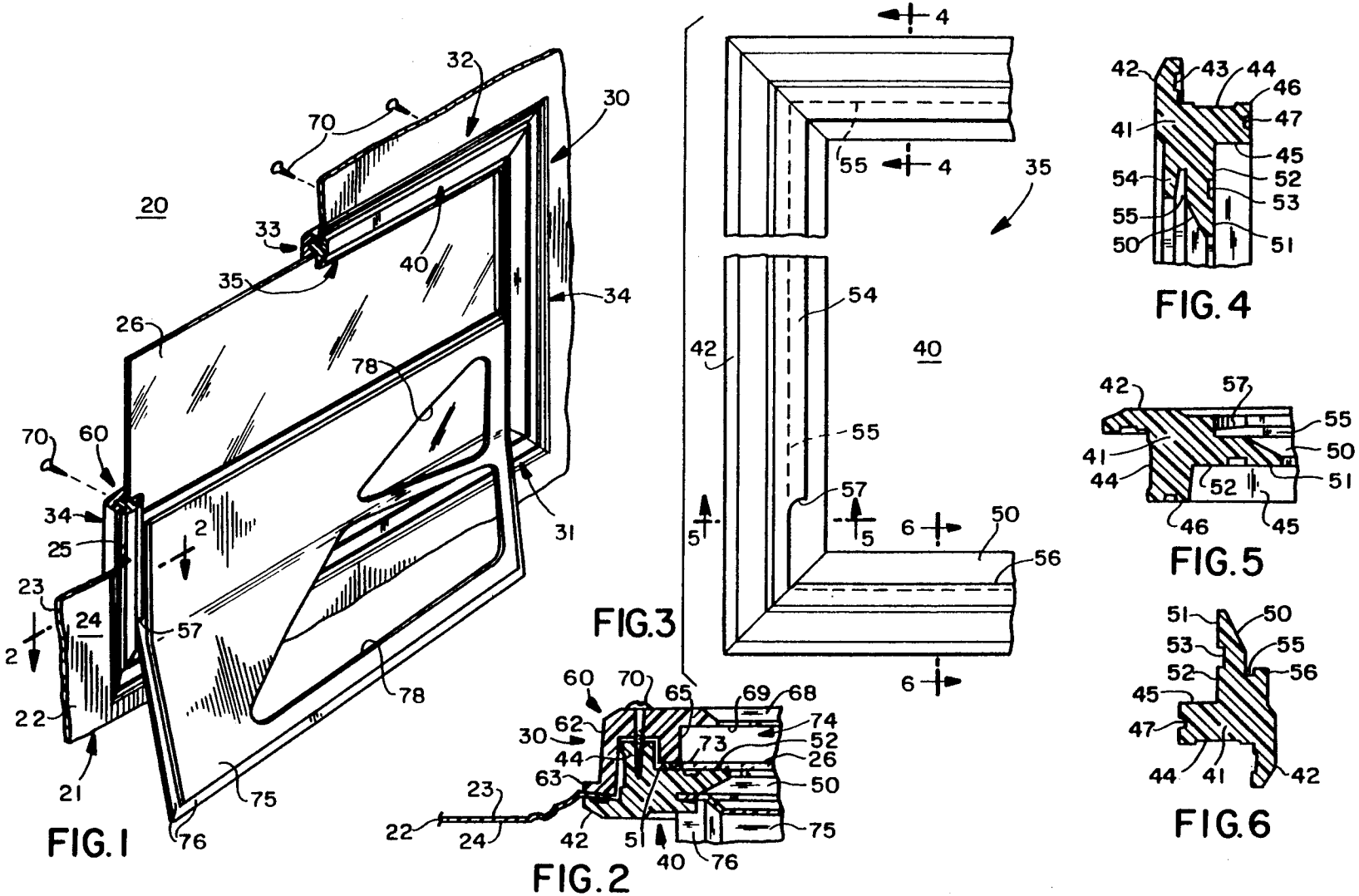
FIG. 1 is a fragmentary perspective view of a door light assembly constructed in accordance with and embodying the features of a first embodiment of the present invention.
FIG. 2 is an enlarged, fragmentary sectional view taken along the line 2—2 in FIG. 1.
FIG. 3 is an enlarged, fragmentary, front elevational view of the outer frame structure of the door light assembly of FIG. 1.
FIG. 4 is a further enlarged, fragmentary, sectional view taken along the line 4—4 in FIG. 3.
FIG. 5 is a further enlarged, fragmentary, sectional view taken along the line 5—5 in FIG. 3.
FIG. 6 is a further enlarged, fragmentary, sectional view taken along the line 6—6 in FIG. 3.

Referring to FIGS. 1 and 2, there is illustrated a door light assembly, generally designated by the numeral 20, constructed in accordance with and embodying the features of a first embodiment of the invention. The door light assembly 20 is for use with a well structure, which my be a door 21, such as a raised panel steel ("RPS") door having a panel 22 with inner and outer sides 23 and 24 having a rectangular opening 25 formed therein. The door light assembly 20 is for the purpose of mounting a window pane unit in the opening 25. It is a fundamental aspect of the invention, that the door light assembly 20 is designed so as to mount either of two different window pane units having different thicknesses, such as a single strength, non-insulated first window pane unit 26 or an insulated second window pane unit 27 (see FIGS. 11-12A) which includes a pair of glass panes 28 spaced apart by an insulating air gap and sealed in their spaced-apart configuration by a peripheral rim 29.

The door light assembly 20 includes a frame assembly 30, which is substantially rectangular in shape and is dimensioned to fit the opening 25 in the door 21. More specifically, the frame assembly 30 includes a lower portion 31 which comprises a bottom section and an upper portion 32 which comprises a top section 33 and a pair of opposed side sections 34, the lower and upper portions 31 and 32 cooperating to define a rectangular aperture 35 therethrough. The frame assembly 30 is formed of an outer frame structure 40 and an inner frame structure 60 interconnected in an assembled configuration illustrated in FIGS. 1 and 2, so as to clamp therebetween the window pane unit 26 or 27 in a manner described more fully below.

Referring now also to FIGS. 3-6, the outer frame structure 40 is rectangular in shape and includes bottom, top and side sections, which may be formed independently and joined at the corners of the rectangle, or may be formed as a unit and bent into the rectangular configuration. The outer frame structure 40 has a body 41 which extends around the periphery of the aperture 35 and is provided along its entire length with a laterally outwardly projecting mounting flange 42 having a recess 43 formed in the inner surface thereof along the entire length thereof. Also projecting from the body 41, generally perpendicular to the mounting flange 42 along the entire length of the body 41, is a projection 44 which is provided with a flat planar side surface 45 facing the aperture 35 and an end surface 46 provided with a groove 47 therein. Projecting laterally inwardly from the body 41 along its entire length, in a direction generally opposite to that of the mounting flange 42, is a support flange 50, having formed on the inner side thereof first and second outer support surfaces 51 and 52 which are substantially coplanar and extend around the entire perimeter of the aperture 35, being spaced apart by a recess 53.

Projecting from the body 41 generally parallel and in the same direction as the support flange 51, is a flange 54 which is spaced just forwardly of the support flange 50, the flanges 50 and 54 forming spaced-apart wall portions which cooperate to define therebetween a groove 55 which extends around the perimeter of the aperture 35. The flange 54 is shortened along the bottom section of the frame structure 40, as at 56 (FIG. 6), so that the groove 55 is shallower along the bottom of the frame structure 40. The flange 54 is cut away, as at 57, at the lower end of each of the side sections of the outer frame structure 40 (FIGS. 3 and 5) to define access openings into the groove 55, for a purpose to be explained more fully below.

Figures 7, 8, 9, 10, 11, 12, 12A:
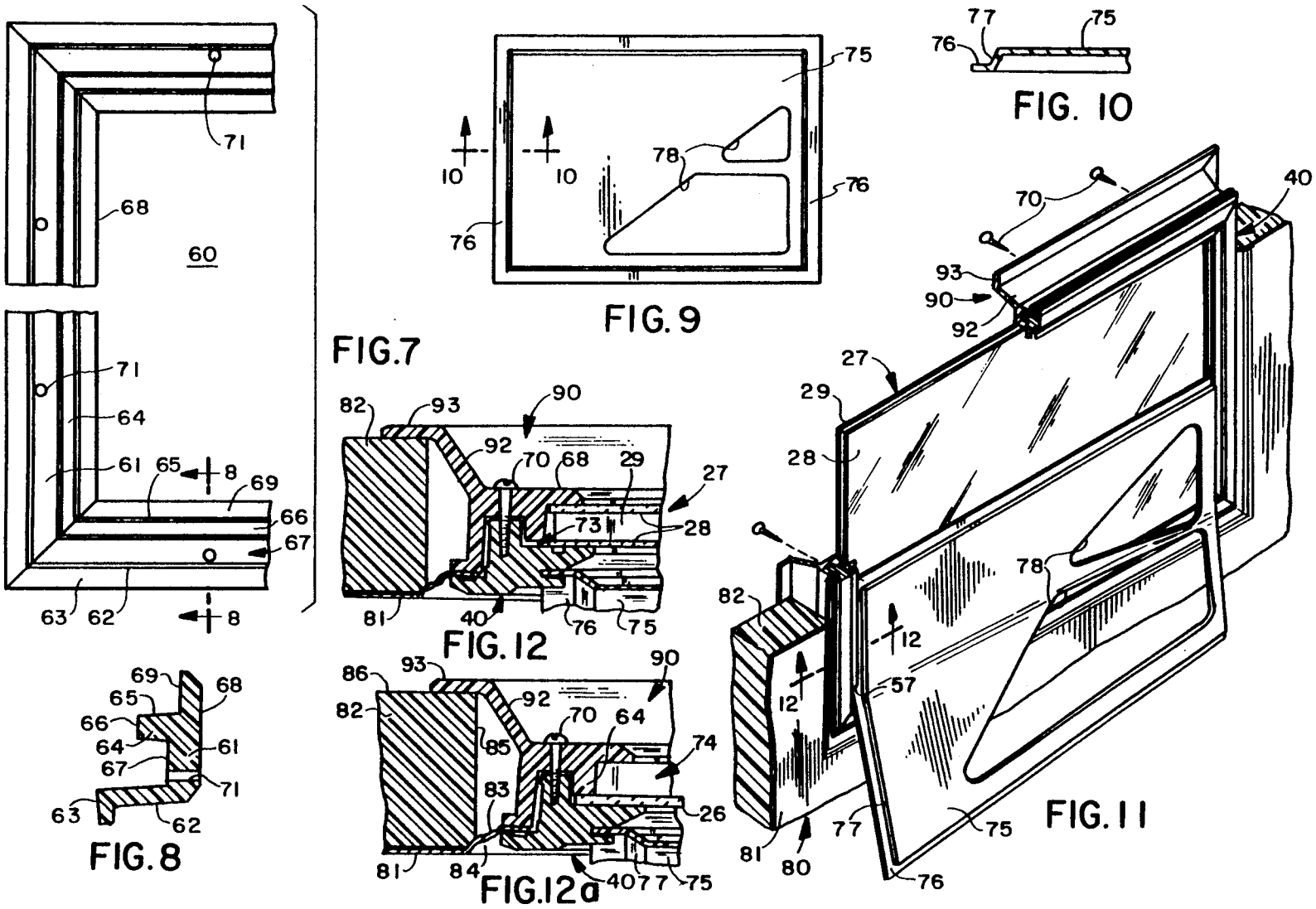
FIG. 7 is a front elevational view, similar to FIG. 3, of the inner frame structure of the door light assembly of FIG. 1.
FIG. 8 is an enlarged sectional view taken along the line 8—8 in FIG. 7.
FIG. 9 is a reduced front elevational view of the decorative insert of the door light assembly of FIG. 1.
FIG. 10 is an enlarged, fragmentary, sectional view taken along the line 10—10 in FIG. 9.
FIG. 11 is a view, similar to FIG. 1, of a door light assembly constructed in accordance with a second embodiment of the invention.
FIG. 12 is an enlarged, fragmentary, sectional view taken along the line 12—12 in FIG. 11.
FIG. 12A is a view similar to FIG. 12, illustrating the mounting of a single strength, non-insulated window pane unit in the door light assembly of FIG. 11.
Figure 15:
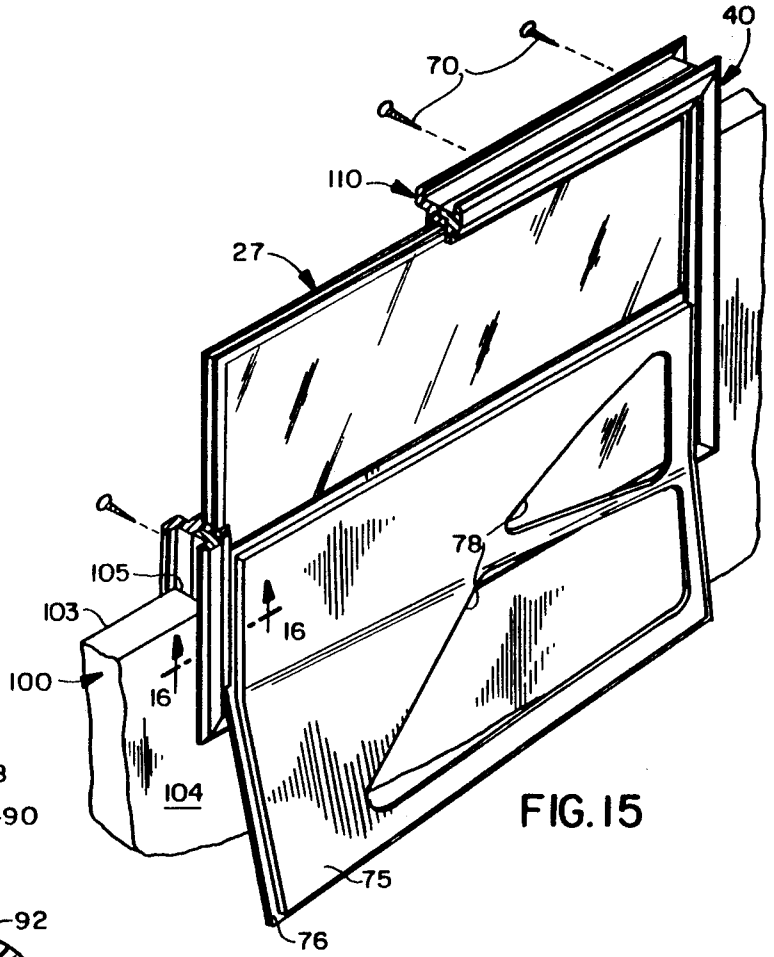
FIG. 15 is a view similar to FIG. 11, illustrating a door light assembly in accordance with a third embodiment of the present invention.
Figure 14:
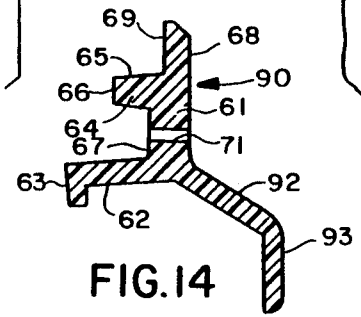
FIG. 14 is a further enlarged sectional view taken along the line 14—14 in FIG. 13.
Figure 13:
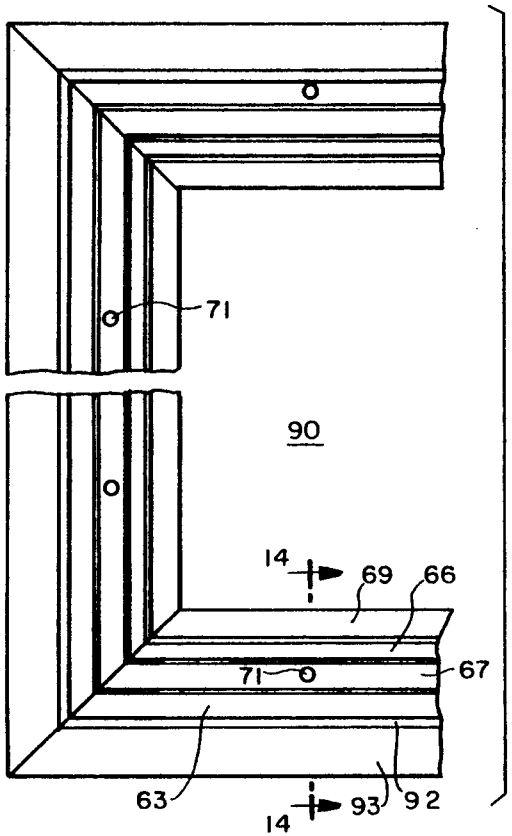
FIG. 13 is an enlarged, fragmentary, rear elevational view similar of the inner frame structure of the door light assembly of FIG. 11.
Figure 17:
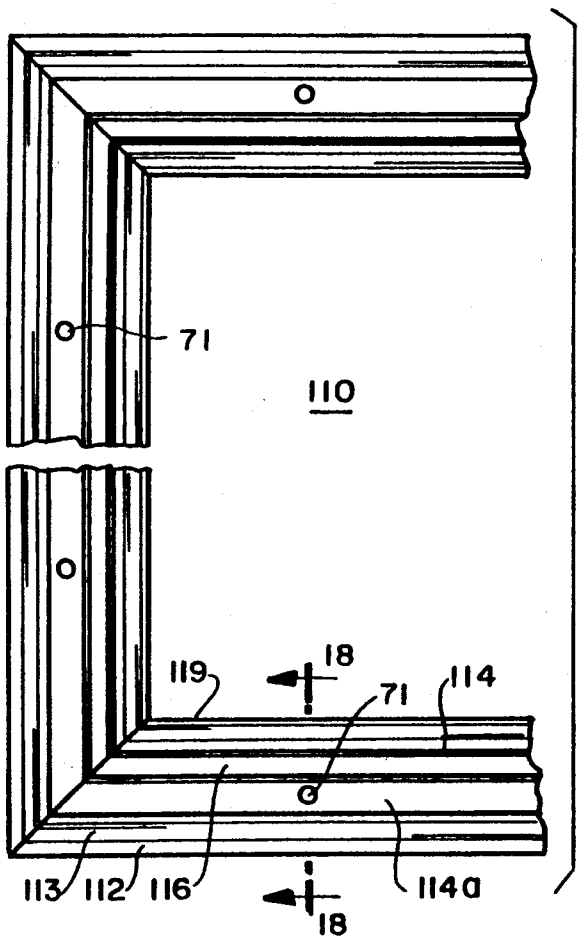
FIG. 17 is a view similar to FIG. 7, of the inner frame structure of the door light assembly of FIG. 15.
Figure 18:
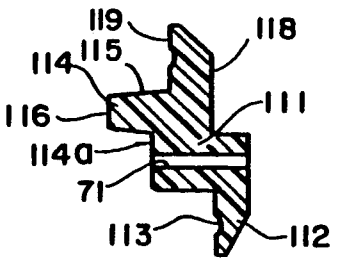
FIG. 18 is an enlarged, sectional view taken along the line 18—18 in FIG. 17.
Figure 16:
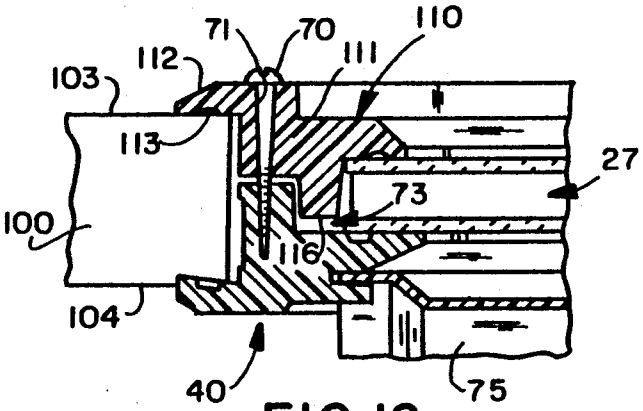
FIG. 16 is an enlarged, fragmentary, sectional view taken along the line 16—16 in FIG. 15.
Figure 16A:
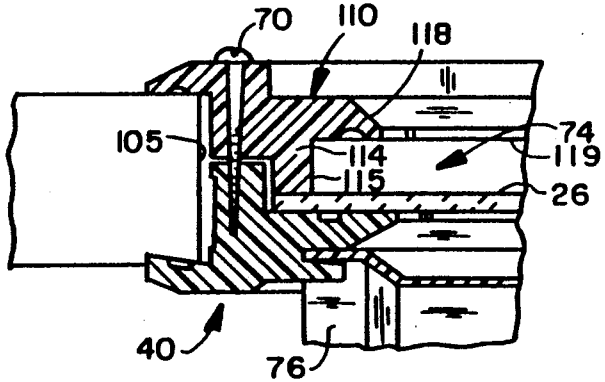
FIG. 16A is a view similar to FIG. 16, illustrating mounting of a single strength, non-insulated window pane unit in the door light assembly of FIG. 15

Referring now also to FIGS. 7 and 8, the inner frame structure 60 is also rectangular in shape and includes top, bottom and side sections, and may be formed in substantially the same manner as the outer frame structure 40. The inner frame structure 60 has a body 61 which extends around the perimeter of the aperture 35 and is provided along its entire length with a forwardly projecting leg 62, provided at its distal end with a laterally outwardly extending mounting flange 63. Also projecting forwardly from the body 61 along its entire length is a projection 64 which has a planar side surface 65 facing inwardly toward the aperture 35 and a forward end first inner support surface 66. The projection 64 is spaced laterally inwardly from the leg 62 and cooperates therewith to define therebetween a channel 67. Projecting laterally inwardly from the body 61, along its entire length, substantially perpendicular to the projection 64, is a support flange 68, provided at its front side with a second inner support surface 69.

In use, the outer and inner frame structures 40 and 60 are secured together in an assembled configuration, illustrated in FIGS. 1 and 2, with the projection 44 of the outer frame structure 40 disposed in the channel 67 of the inner frame structure 60. More specifically, the frame structures 40 and 60 are secured together by a plurality of screws 70 which, respectively, extend through complementary holes 71 which are longitudinally spaced-apart in the body 61 of the inner frame structure. The holes 71 are positioned to align with the groove 47 in the projection 44 when the parts are assembled, the groove 47 serving as a starter or pilot hole for the screws 70 in the projection 44.

It can be seen that, when the frame structures 40 and 60 are thus secured together in their assembled configuration, the first support surfaces 51 and 66 are spaced apart for cooperation with the side surface 45 of the projection 44 to define a relative narrow first channel 73, substantially rectangular in transverse cross section, extending around the entire perimeter of the frame assembly 30. Similarly, the second support surfaces 52 and 69 are spaced apart for cooperation with the side surface 65 of the projection 64 to define a relatively wide second channel 74, substantially rectangular in transverse cross section, and extending around the entire perimeter of the frame assembly 30. It can be seen that, because the side surface 65 is spaced laterally inwardly with respect to the side surface 45, the outer perimeter of the channel 74 is less than that of the channel 73. The channel 73 is dimensioned to accommodate a non-insulated pane unit 26, while the channel 74 is dimensioned to accommodate an insulated pane unit 27.

In mounting the door light assembly 20 in the door opening 25, the outer and inner frame structures 40 and 60 are respectively disposed in the opening 25, with the window pane unit 26 disposed therebetween in the channel 73. The frame structures 40 and 60 are so arranged that the mounting flanges 42 and 63, respectively, engage the outer and inner sides 24 and 23 of the door panel 22 around the entire perimeter of the opening 25. When the parts are thus properly positioned, the outer and inner frame structures 40 and 60 are secured together with the screws 70 thereby to securely clamp the door panel 22 between the mounting flanges 42 and 63 and to clamp the window pane unit 26 in the channel 73 between the support surfaces 51 and 66. It will be appreciated that, in like manner, an insulated pane unit 27 could be mounted in the door light assembly 20. In this case, the pane unit 27 would be disposed in the channel 74, so that when the frame structures 40 and 60 are screwed together, the pane unit 27 would be securely clamped between the support surfaces 52 and 69.

Referring now also to FIGS. 9 and 10, the door light assembly 20 includes a decorative insert 75 which is in the form of a rectangular sheet joined around its perimeter to an offset peripheral edge 76 by an inclined shoulder 77. The insert 75 has one or more openings 78 formed therethrough. In use, the insert 75 is designed to be mounted in the frame assembly 30 for covering the window pane unit 26 or 27, so that only portions of the pane are visible through the openings 78 to give the appearance of different shaped panes. It is a significant aspect of the invention that the insert 75 can be mounted and demounted with respect to the frame assembly 30 in its assembled configuration without disassembly thereof. In this regard, referring in particular to FIGS. 1-3, the insert 75 is preferably formed of a flexible material, such as plastic, and is dimensioned so that the peripheral edge 76 just fits in the groove 55 of the outer frame structure 40. In order to mount the insert 75, the upper corners of the peripheral edge 76 are inserted into the groove 55 through the access openings defined by the cutaways 57, and is pushed up until the top edge of the insert 75 is seated in the top portion of the groove 55. This will permit the bottom edge of the insert 75 to clear the top of the shortened lower flange 56 (FIGS. 3 and 6), so that the bottom of the peripheral edge 76 can then drop into the bottom of the groove 55. When it is desired to demount the insert 75, such as to replace it with another, it is simply slid up to the top of the groove 55 so that the bottom portion of the peripheral edge 76 can clear the lower flange 56, and is then pulled out through the access openings formed by the cutaways 57.

Another important aspect of the invention is that the door light assembly 20 is adapted for use with different types of door construction. In this regard, the outer frame structure 40 is universal, i.e., it is included in the frame assembly 30 irrespective of the type of door construction in which the door light assembly 20 is to be mounted. However, the inner frame structure is changed, depending on the door construction.

Referring now also to FIGS. 11-14, another type of door construction with which the present invention can be used is an RPS insulated door 80, which includes a raised panel 81 having inner and outer sides 83 and 84, and being provided along its inner side 83 with thick layer of insulation 82 which has an inner side 86. An opening 85 is formed in the door 80 to accommodate the door light assembly and, typically, the edge of the panel 81 projects into the opening 85 beyond the edge of the insulation 82.

For use with the door 80, the door light assembly 20 includes an inner frame structure 90 which is substituted for the inner frame structure 60 and is substantially similar thereto in construction, with like parts of the two structures bearing the same reference numerals. The inner frame structure 90 differs from the inner frame structure 60 in that it includes a leg 92 projecting laterally outwardly and rearwardly from the body 61 around the entire perimeter thereof, the leg 92 being provided at its distal end with a laterally outwardly projecting mounting flange 93.

The inner frame structure 90 is used with the outer frame structure 40 in exactly the same manner as the inner frame structure 60, described above. However, when the parts are disposed in their assembled configuration, the mounting flange 93 bears tightly against the inner side 86 of the door insulation 82 for cooperation with the mounting flanges 42 and 63 securely to clamp the door light assembly 20 to the door 80 around the entire perimeter of the opening 85. In the case of the insulated door 80, the door light assembly will typically mount therein an insulated pane unit 27, as illustrated in FIG. 12, although it will be appreciated that it could also be used to mount a non-insulated pane unit 26, as is illustrated in FIG. 12A.

Referring now also to FIGS. 15-18, the door light assembly 20 could also be used with a foam core door 100, which has inner and outer sides 103 and 104 and a rectangular opening 105 therein. In this event, an inner frame structure 110 is substituted for the inner frame structure 60 and is similar in construction thereto. More specifically, the inner frame structure 110 has a body 111 which is provided along the entire length thereof with a mounting leg 112 which projects laterally outwardly from the inner end thereof along the entire perimeter of the frame assembly 30, and is provided along its front or outer surface with a recess 113. The body a front or outer surface 114*a* from the laterally inner end of which a projection 114 extends forwardly or outwardly. The projection 114 has a planar side surface 115 and a front or outer support surface 116. Integral with the body 111 and projecting laterally inwardly therefrom around the entire perimeter thereof is a support flange 118 which has a front or outer support surface 119.

In assembly, the inner frame structure 110 cooperates with the outer frame structure 40 in much the same way as the inner frame structure 60, described above. The end surface 46 of the outer frame structure 40 is drawn against the end surface 114*a* alongside the projection 114 by the screws 70, with the support surface 116 cooperating with the support surface 52 to define the channel 73, and with the support surface 119 cooperating with the support surface 52 to define the channel 74. In the assembled configuration, the mounting leg 112 bears against the inner side 103 of the door 100 for cooperation with the mounting flange 42 to define a third channel and securely to clamp the door 100 therebetween around the entire perimeter of the opening 105, fixedly to mount the door light assembly 20 in place.

It will be appreciated that, in all of the embodiments of the door light assembly 20, a suitable sealant (not shown) may be applied to the door light assembly 20 after assembly, as between the pane unit 26 or 27 and the inner edge of the support flange 50, in a known manner. The frame assembly 30 may be formed of any suitable material, but in the preferred embodiment, is formed of foamed rigid PVC. The inner and outer frame structures 40, 60, 90 and 110 are preferably formed by extrusion, but it will be appreciated that they could be formed by other techniques, such as molding.

From the foregoing, it can be seen that there has been provided an improved door light assembly which is readily adaptable for use with different types of doors and is adapted for mounting either of two different thicknesses of window pane unit, while at the same time permitting simple mounting and demounting of a decorative insert without disassembly.

I claim:

1. Window framing structure or accommodating an associated window panel unit comprising: peripheral frame body means defining an aperture therethrough and shaped and dimensioned to extend around the periphery of an associated window pane unit for secure attachment thereto, said body mean including spaced-apart wall portions cooperating to define therebetween a groove extending around the perimeter of an opening toward said aperture, one of said wall portions being cut away at spaced-apart locations thereon to define access openings to said groove, and a flexible insert shaped and dimensioned to cover said aperture and having a peripheral edge receivable in said groove through said access openings for accommodating movement of said insert to and from a mounted position wherein said insert covers said aperture and it retained around its entire perimeter in said groove solely by said wall portions.

2. The framing structure of claim 1, wherein said frame body means is substantially rectangular in shape and defines a substantially rectangular aperture therethrough.

3. The framing structure of claim 2, wherein said access openings are disposed on opposite sides of said aperture.

4. The framing structure of claim 1, wherein said groove has upper and lower potions such that the depth of the lower portion is less than that of said upper portion.

5. The framing structure of claim 4, wherein said access openings are disposed adjacent to said lower portion of said groove.

6. The framing structure of claim 1, wherein said insert has one or more apertures formed therethrough for exposing an associated window pane unit carried by said frame body means.

7. A light unit frame assembly for installing an associated window pane unit in an opening in a wall structure having inner and outer sides, said frame assembly comprising: an inner peripheral frame structure adapted to be disposed in the opening in the associated wall structure and to extend around the periphery thereof and having an inner mounting portion and first and second inner pane support surfaces, an outer peripheral frame structure adapted to be disposed in the opening in the associated wall structure and to extend around the periphery thereof and having an outer mounting portion and first and second outer pane support surfaces, and attachment means or securing said inner and outer frame structures together in an assembled condition with said inner and outer mounting portions respectively disposed for firm engagement with the inner and outer sides of the associated wall structure around the perimeter of the opening therein, said inner and outer peripheral frame structures respectively having inner and outer peripheral projections, said inner and outer projections respectively projecting toward said outer and inner frame structures in overlapping relationship when said frame structures are disposed in their assembled condition, said first inner and outerpane support surfaces being spaced apart a first predetermined distance when said frame structures are disposed in their assembled condition for cooperation to define a first channel adapted to receive therein a first associated pane unit having a first thickness or firm support thereof in surface-to-surface contact therewith, said second inner and outer pane support surfaces being spaced apart a second predetermined distance when said inner and outer frame structures are disposed in their assembled condition for cooperation to define a second channel adapted to receive therein a second associated pane unit discrete from said first pane unit having a second thickness for firm support thereof in surface-to-surface contact therewith.

8. The frame assembly of claim 7, wherein said attachment means includes a plurality of fasteners spaced apart around the perimeter of said frame structure.

9. The frame assembly of claim 7, wherein said first and second outer pane support surfaces are substantially coplanar.

10. The frame assembly of claim 7, wherein said frame structures in their assembled condition cooperate to define first and second end surfaces respectively closing said first and second channels along the outer perimeters thereof.

11. The frame assembly of claim 7, wherein said outer peripheral frame structure defines an aperture therethrough and further includes a groove extending around the perimeter thereof and opening toward said aperture, and means defining access openings to said groove at spaced-apart locations therealong, and further comprising a flexible insert shaped and dimensioned to cover said aperture and having a peripheral edge receivable in said groove through said access openings.

12. The frame assembly of claim 7, wherein said inner and outer peripheral frame structures are substantially rectangular in shape.

13. The frame assembly of claim 7, wherein said inner peripheral frame structure further includes an intermediate mounting structure adapted for engagement with the associated wall structure between the inner and outer sides thereof around the perimeter of the opening therein.

* * * * *